United States Patent [19]

Zwirn et al.

[11] Patent Number: 4,474,343

[45] Date of Patent: Oct. 2, 1984

[54] JITTER COMPENSATING SCENE STABILIZING MISSILE GUIDANCE SYSTEM

[75] Inventors: Robert Zwirn; John W. Bozeman, both of Los Angeles, Calif.

[73] Assignee: Hughes Aircraft Company, El Segundo, Calif.

[21] Appl. No.: 260,236

[22] Filed: May 4, 1981

[51] Int. Cl.[3] ..... F41G 7/20

[52] U.S. Cl. ..... 244/3.11

[58] Field of Search ..... 244/3.11, 3.12, 3.13, 244/3.14

[56] References Cited

U.S. PATENT DOCUMENTS

| | | | |
|---|---|---|---|
| 2,930,894 | 3/1960 | Bozeman | 244/3.11 |
| 3,098,933 | 7/1963 | Barasch | 244/3.14 |
| 3,711,046 | 1/1973 | Barhydt et al. | 244/3.12 |
| 3,751,166 | 8/1973 | Starkey et al. | 244/3.16 |
| 3,761,180 | 9/1973 | Maxwell, Jr. et al. | 244/3.13 |
| 3,820,742 | 6/1974 | Watkins | 244/3.11 |
| 3,848,830 | 11/1974 | Born | 244/3.16 |
| 3,954,228 | 5/1976 | Davis, Jr. | 244/3.16 |
| 3,998,406 | 12/1976 | Smith et al. | 244/3.11 |
| 4,027,837 | 6/1977 | Miller, Jr. et al. | 244/3.11 |
| 4,047,117 | 9/1977 | Tuchyner et al. | 244/3.16 |
| 4,047,678 | 9/1977 | Miller, Jr. et al. | 244/3.16 |
| 4,162,052 | 7/1979 | Lamelot | 244/3.16 |
| 4,174,818 | 11/1979 | Glenn | 244/3.13 |

*Primary Examiner*—Charles T. Jordan

*Attorney, Agent, or Firm*—W. J. Benman, Jr.; W. J. Bethurum; A. W. Karambelas

[57] ABSTRACT

An improved missile guidance system is provided which automatically compensates for jitter motion of the optical sight of a video tracker. The invention is adapted to receive video data input from an infrared detector or conventional camera. The invention includes circuits for filtering, gating, and digitalizing the incoming data as well as a formatter for directing successive frames into memory. Two memories are provided; the contents of which are sampled by matching logic as the second memory is being loaded. The matching logic thereby compares one frame of data to another at plurality of positions and provides a signal to an address latch when the best match is obtained. The format circuitry provides the position information to the address latch where it is stored for further processing. The output of the address latch is filtered to eliminate any signals representative of intentional tracking motion. The filtered output thus provides the jitter correction to the missile guidance system where missile guidance signals are compensated by the jitter correction.

6 Claims, 4 Drawing Figures a.
b.
c.
d.
RAW VIDEO
BANDPASSED VIDEO
BINARY VIDEO
REFORMATTED VIDEO a.
b.
c.
d.
RAW VIDEO
BANDPASSED VIDEO
BINARY VIDEO
REFORMATTED VIDEO

JITTER COMPENSATING SCENE STABILIZING MISSILE GUIDANCE SYSTEM

BACKGROUND OF THE INVENTION

1. Field of the Invention

This invention relates to missile guidance systems. More specifically, this invention relates to improvements in the guidance of line-of-sight commanded missiles.

While the present invention is described herein with reference to particular embodiments and applications, it is to be understood that the invention is not limited thereto. Modifications may be made within the teachings of this invention without departing from the true spirit and scope thereof.

2. Description of the Prior Art

A typical line-of-sight guided missile system includes a launcher and a guided missile. The launcher typically includes a gunner's optical sight and an electronic guidance computer which automatically sends steering commands to the missile in flight. After launch, a beacon in the tail of the missile is activated and subsequently detected by a sensor on the launcher. The sensor is bore sighted with the gunner's telescope, and allows the operator to track the missile along its flight path. The sensor and associated processing circuitry measures the angle between the flight direction of the missile and the gunner's line-of-sight. These displacements are transformed by a computer into guidance commands which are sent to the missile over the command link. The gunner need only keep the crosshairs of the sight on the target during missile flight.

Unfortunately, in an actual hostile operational environment, the operator may experience nervous jitters which would tend to impair his ability to maintain the cross-hairs on the center of the target's most vulnerable aim point. If the operator jitters the sensor line-of-sight, the missile tracker would measure a corresponding apparent missile off-set. As it corrected the nonexistant off-set, it would create perturbations which would appear as noise in the missile guidance signals. This would detract from the hit-accuracy of the guidance and tracking system.

SUMMARY OF THE INVENTION

The present invention provides means for improving the performance of line-of-sight commanded missile guidance systems.

The present invention utilizes a video sensor for providing successive frames of data corresponding to at least a portion of a video scene as viewed by the operator through an optical sight. Signal processing circuitry is provided for analyzing the frames of data to provide electrical signals indicative of the jitter motion of the optical sight relative to stationary objects in the video scene.

More specifically, the present invention includes means for converting information representative of the video scene into a train of discrete signals. Successive frames of discrete data are then compared on a pixel by pixel basis until a best match is obtained. (A "pixel" is an individual picture element.) The address at which the best match is obtained provides information indicative of the jitter motion of the tracking system. (The "address" is the reference in number of rows and columns in each frame.) Data must be successively displaced to achieve the best match to a prior frame's reference (or address) This information is then utilized to off-set the jitter motion effect on the missile guidance signals.

DETAILED DESCRIPTION OF THE INVENTION

This invention substantially eliminates the effect of gunner jitter by initially tracking arbitrary portions of the background of a video scene remote from the target. The basis for estimating the gunner jitter is the apparent motion of the stationary scene. By measuring how elements of the scene, remote from the target, appear to be moving, gunner jitter may be estimated. The estimation is represented by electrical signals which are subtracted from the missile guidance signals so that the normally occurring gunner jitter is suppressed.

Figure 1:
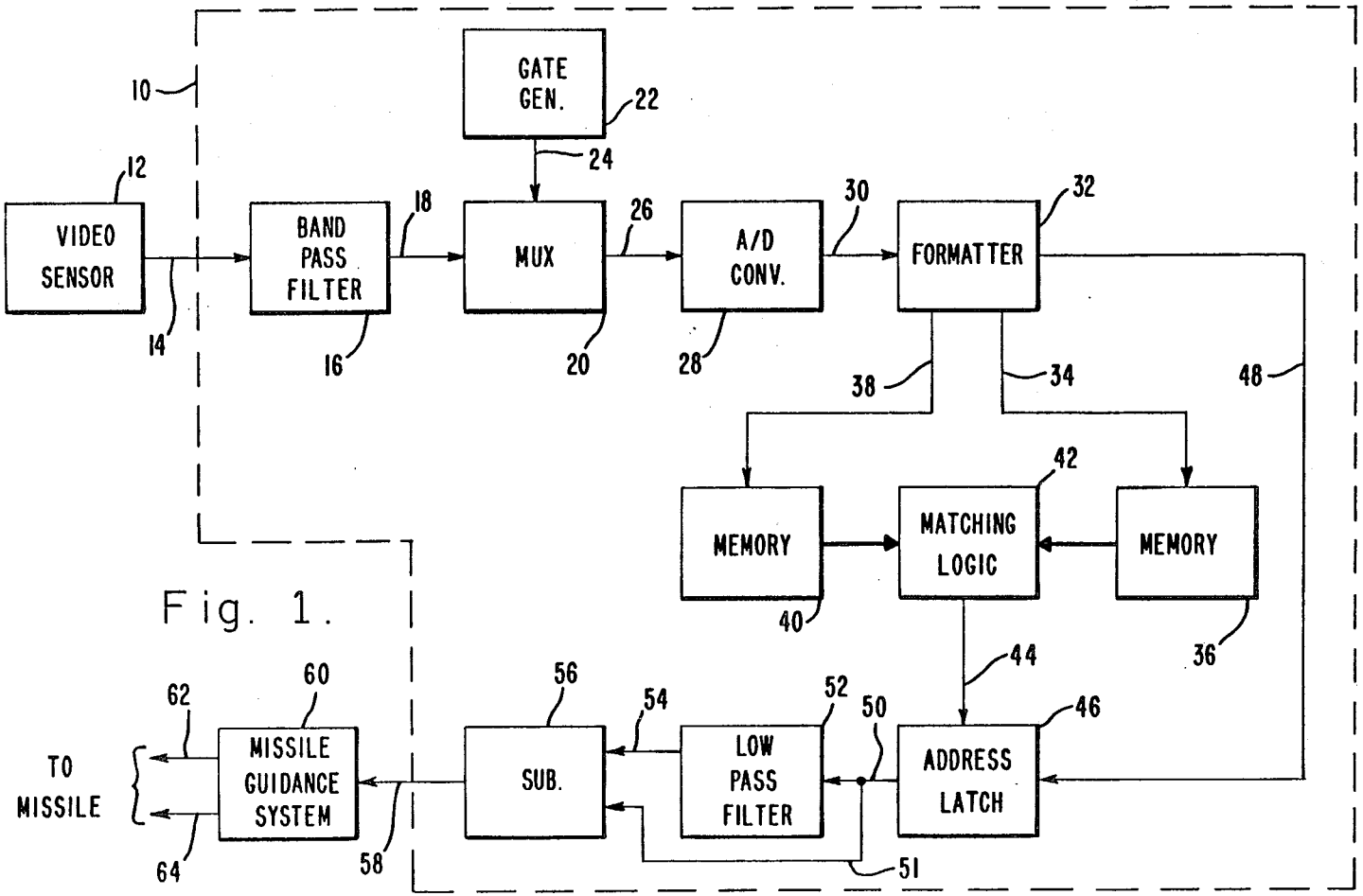
FIG. 1 is a diagrammatic representation of a preferred embodiment of the invention.

FIG. 1 shows a block diagram representing of a digital system designed to suppress gunner jitter. It should be noted that while a digital system is disclosed, the principals of the present invention may be realized through equivalent analog circuitry. The gunner jitter suppression circuit is shown at 10 in FIG. 1. The suppression system 10 is adapted to receive video data from a video sensor 12. The video sensor 12 may be a forward looking infrared (FLIR) sensor or an electronic T.V. camera. The video sensor block would also include a display and/or an optical sight through which the operator may view the video scene. The video output of sensor 12 appears on line 14 and is input to the bandpass filter 16. The bandpass filter 16 is effective as a differentiator to transform the video data so that subsequent correlations may be more easily measured and identified. The effect of differentiation is to delineate scene boundaries. The processing scheme of the present invention utilizes boundary change information to estimate gunner jitter.

The output of the bandpass filter 16 provides one input to a multiplexer 20 via line 18. The second input to the multiplexer 20 is provided by the gate generator 22 via line 24. The multiplexer 20 and gate generator 22 operate on the analog video output of the filter in such a way as to pass data representing portions of the video scene remote from the center of the field of view. Thus, gated video appears at the output of multiplexer 20 on line 26 and is input to an analog-to-digital (A/D) converter 28.

The A/D converter 28 thresholds the video data to produce a mosaic of 1's and 0's. See FIGS. 2 and 3. This stream of binary video is input to a formatter 32 via line 30. The formater 32 directs video data into a first memory 36 via line 34 until a first frame of gated video is stored. Similarly, video data is subsequently formatted into a second memory 40 via line 38.

Figure 2:
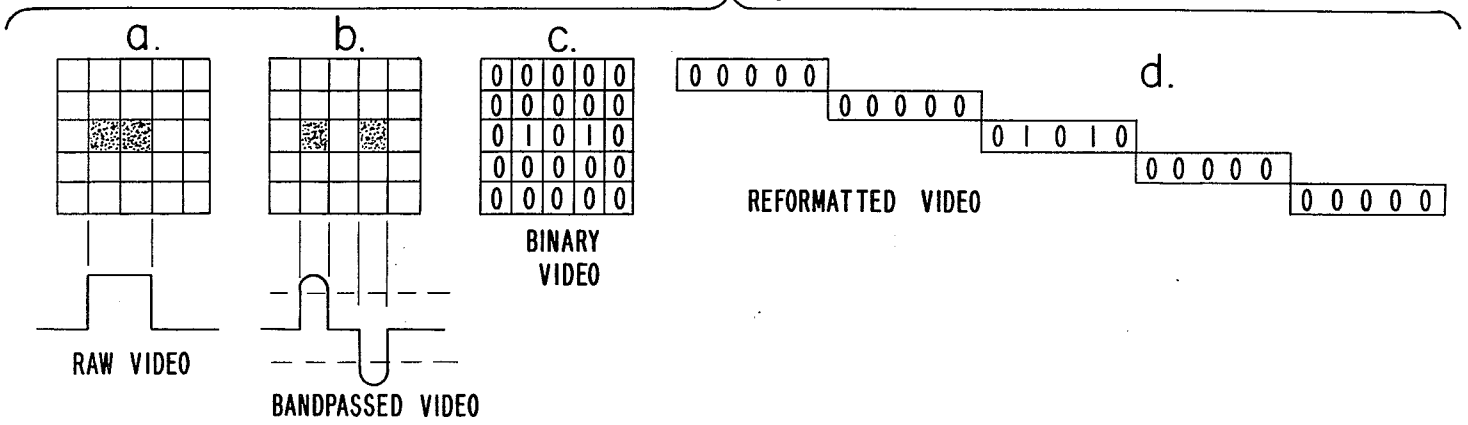
FIG. 2 is representative of the processing of a first frame of video data by the system of the present invention.
Figure 3:
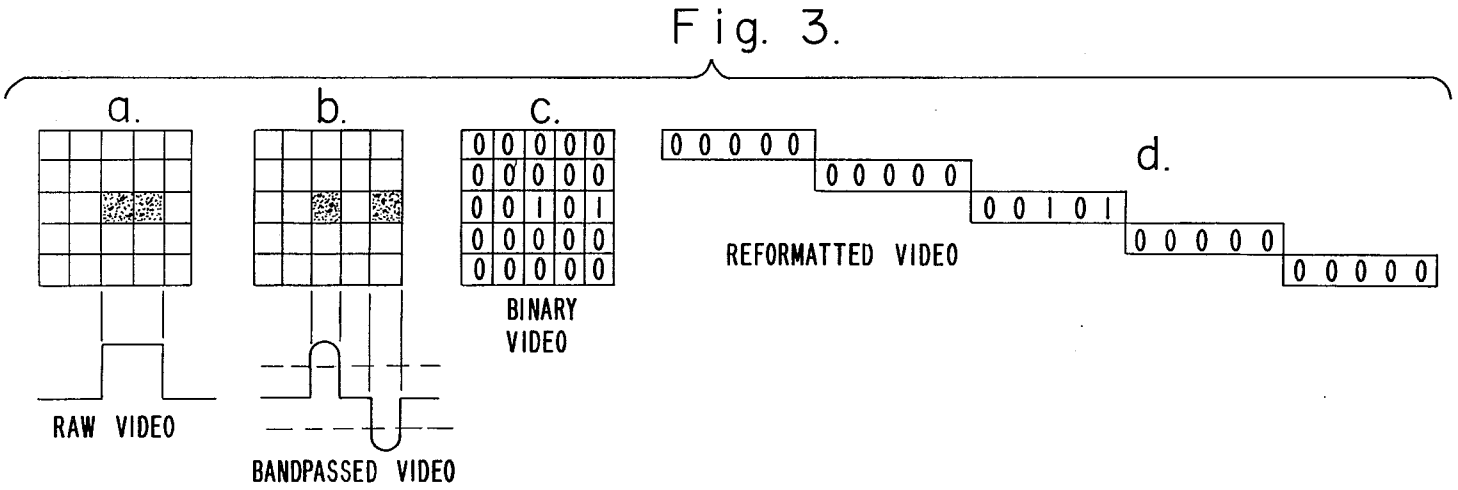
FIG. 3 is representative of the processing of a second frame of video data by the system of the present invention.

FIGS. 2 and 3 illustrate the processing of the data up to this point. FIG. 2*a* shows that the first frame of data appears at the output of video sensor 12 as raw video. The upper portion of the figure illustrates a portion of a typical video scene with the background clutter represented as a shaded area. The filtered video for the corresponding line of data is represented in the lower portion of the figure as a pulse two units wide.

FIG. 2*b* is illustrative of the same video bandpassed by filter 16. The upper portion of the figure now shows the boundaries as shaded areas while the lower portion of the figure is representative of the derivative of the pulse in FIG. 2*a*.

FIG. 2*c* shows the same portion of the video scene at the output of the analog-to-digital converter 28. Shaded portions are represented by 1's; the remaining portions are represented by 0's. FIG. 2*c* is thus a mosaic of 1's and 0's. Formater 32 provides the formatted video of frame 1 to memory 36 in a format typified in FIG. 2*d*.

FIG. 3 illustrates that the second frame of data corresponds to a jitter motion effective to displace the sensor one element to the left. Note that the raw video of FIG. 2*a* is now moved to the right by one unit as illustrated in FIG. 3*a*. Subsequent filtering, digitalizing, and formating, in the manner described above, yields a displacement of one unit to the right of the 1's in the data stream associated with line 3 of FIG. 3*d*.

Video detector 12, bandpass filter 16, multiplexer 20, gate generator 22, analog-to-digital converter 28, and formattor 32 thus provide successive frames of video data for processing in the manner described below.

Returning now to FIG. 1, the information stored in memories 36 and 40 is compared by matching logic 42. The matching logic may be provided by a computer or other digital or analog circuitry.

Figure 4:
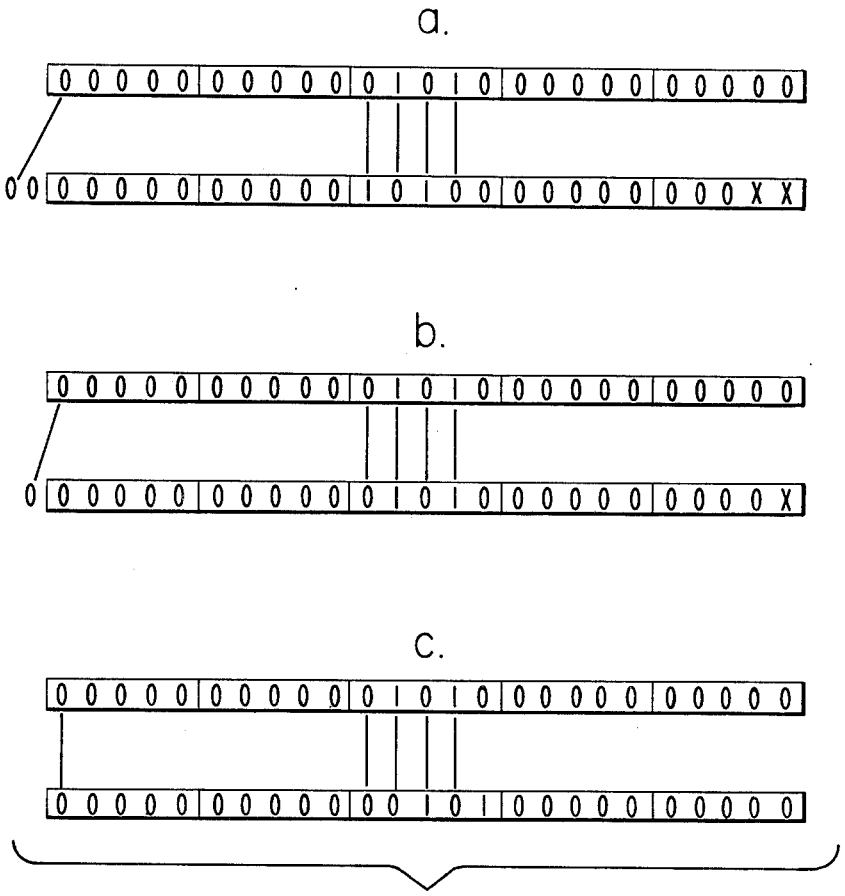
FIG. 4 illustrates the method by which successive frames of data are compared by the system of the present invention.

After frame 1 is loaded in memory 36, matching logic 42 samples frame 2 as it is being formatted into memory. The data in memory 40 is sampled and compared at every step or pixel. The location which gives the best overall match is referenced to the last frame's location in order to compute incremental motion. The process is illustrated in FIG. 4.

FIG. 4*a* shows that at position N−1 there are 21 pixels which match and 4 pixels which do not match. The X's indicate "don't cares". FIG. 4*b* illustrates that the data has marched one position in time to where the number of matches is 25. FIG. 4*b* thus illustrates position N. FIG. 4*c* illustrates position N+1 where the number of matches is once again 21. Position N therefore provides the best match and indicates the displacement of the scene due to gunner jitter to be one pixel to the left.

When matching logic detects the best match, it signals address latch 46 via line 44. At that point the address latch interrogates the formatter 32 to determine and store the position at which the best match is obtained. This information appears on line 48. The address latch 46 thus provides on line 50 information containing the jitter for say the ith sample or $J_i$.

Memories 36 and 40, matching logic 42, and address latch 46 thus provide means for analyzing successive frames of video data to provide signals indicative of jitter motion of the tracker relative to the video scene.

What remains is to determine whether the incremental motion is in fact jitter motion or tracking motion. That is, scene stabilization must be selective. It must reduce effects of operator jitter while permitting accurate tracking of moving targets. Low-pass filter 52 and subtractor 56 serve to provide this function. The solution to this problem as afforded by the low-pass filter 52 and the subtractor 56 is best illustrated by Equation 1.

$$C_i = J_i - \frac{x = \sum_{i-n}^{i} J_x}{n} \qquad [1]$$

Where $C_i$ is the ith correction corresponding to the ith frame and $J_i$ is the ith jitter sample. Equation 1 illustrates that the jitter correction C for a given frame i is equal to the difference between the incremental jitter sample J; and the average of the previous n jitter samples $$x = \frac{\sum_{i-n}^{i} J_x}{n}.$$

Address latch 46 provides $J_i$ to low-pass filter 52 via line 50 and to subtractor 56 via line 51. Lowpass filter 52 provides the average of the previous jitter samples to the subtractor on line 54. The output of the subtractor on line 58 is the correction C for a frame i.

Equation 1 can be verified functionally when one considers that in a situation where the gunner is in fact causing the tracker to undergo jitter, the effect of the jitter may be sinusoidal in nature. As a result, its average would be zero and the correction would equal the ith jitter sample. However, when the operator is tracking a target, the tracker position does not vary as a sinusoid but more as a ramp. The average behavior of a filtered ramp is another ramp delayed in time. Thus the corresponding correction would be the jitter which rides on the ramp. The filtered ramp is subtracted from this to leave a small value relative to the missile guidance signals.

It should be noted here that the solution to the jitter/-tracking ambiguity of FIG. 1 is illustrative of but one of several possible approaches to the problem. Another approach would be to utilize a high-pass filter to simply filter out the signals corresponding to the low frequency tracking motion of the tracker. Yet another approach would be to utilize an algorithm implemented by a microprocessor such as that which may be provided by the missile guidance system 60. The use of the low-pass filter and subtraction technique is preferred in so far as low-pass filters appear to function better as integrators than high-pass filters function as differentiators.

The correction signal C is ultimately provided to the missile guidance system 60 via line 58 where it is subtracted from the missile guidance commands appearing on line 62 and 64.

Thus, the low-pass filter 52, subtractor 56 and the missile guidance system provides means for compensating the missile guidance signals as a function of the jitter correction signals to provide signals for effectively guiding the missile not withstanding jitter motion of the tracker.

The present invention has been described with reference to a particular embodiment and a particular application. It is contemplated that modifications may be made by those having ordinary skill in the art and access to the teachings disclosed herein which are encompassed within the principles of this invention. For example, systems which include image intensifiers, scan converters, or vidicons can be adapted to use this same correction technique for image-motion compensation. It is thus contemplated by the appended claims to cover any and all such modifications and applications.

We claim:

1. In a missile guidance system including tracking means and means for providing first signals for guiding a missile to a target, an improvement comprising:

means for providing successive frames of data corresponding to at least a portion of a video scene as viewed by said tracking means;

means for analyzing said frames of data and providing second signals indicative of jitter motion of said tracking means relative to said video scene; and means for compensating said first signals as a function of said second signals to provide signals for effectively guiding said missile notwithstanding any jitter motion of said tracking means.

2. The missile guidance system of claim 1 wherein said means for providing successive frames of data corresponding to a video scene includes detector means for detecting optical energy and providing a corresponding electrical output and means for storing said successive frames of data.

3. The missile guidance system of claim 1 or 2 wherein said means for analyzing successive frames of data includes means for correlating successive frames of data and means for storing an electrical signal representative of incremental motion of said tracking means when successive frames correlate.

4. The missile guidance system of claim 1 or 3 wherein said means for compensating said first signals includes means for discriminating between jitter noise and tracking signals.

5. The missile guidance system of claim 4 wherein said means for discriminating between jitter noise and tracking signals includes means for averaging the output of said means for storing an electrical signal representative of incremental motion of said tracking motion means and means for subtracting said average from the instantaneous output of said means for storing electrical signal representative of the incremental motion of said tracking means.

6. A missile guidance system comprising:

means for detecting optical energy and providing video data;

first filter means for differentiating said video data to provide filtered output signals;

gating means for selecting predetermined filtered output signals to provide a gated output;

converter means for transforming said gated output to digital signals;

means for formating said digital signals to provide successive frames of video data;

means for storing said successive frames of video data;

means for comparing said successive frames of video data at a plurality of relative positions to provide an electrical signal indicative of the position at which said frames provide a maximum correlation;

means for storing said electrical signal corresponding to the position at which said frames provide a maximum correlation to provide an electrical signal indicative of the incremental motion of said means for detecting optical energy;

means for processing said electrical signal corresponding to incremental motion of said means for detecting optical energy to discriminate between signals corresponding to jitter motion and signals corresponding to tracking motion; and means for compensating missile guidance signals to correct for noise resulting from jitter motion of said means for detecting optical energy.

* * * * *